United States Patent [19]

Allebach et al.

[11] 4,084,278

[45] Apr. 18, 1978

[54] HIGH SPEED TRANSFER

[75] Inventors: Gene E. Allebach; Robert E. Wisebaker, both of Tiffin, Ohio

[73] Assignee: The National Machinery Company, Tiffin, Ohio

[21] Appl. No.: 710,550

[22] Filed: Aug. 2, 1976

[51] Int. Cl.[2] ..... B21D 43/10; B21D 53/24

[52] U.S. Cl. ..... 10/76 T; 72/405

[58] Field of Search ..... 72/405, 419; 10/11 T, 10/12 T, 72 T, 76 T

[56] References Cited

U.S. PATENT DOCUMENTS

| | | | |
|---|---|---|---|
| 2,100,028 | 11/1937 | Frayer | 10/12 T |
| 2,272,592 | 2/1942 | Wilcox et al. | 10/12 T |
| 2,542,864 | 2/1951 | Friedman | 10/76 T |
| 2,544,218 | 3/1951 | Burdsall | 10/72 T |
| 2,648,077 | 8/1953 | Friedman | 10/12 T |
| 2,689,358 | 9/1954 | De Loe | 10/12 T |
| 3,022,526 | 2/1962 | Davis et al. | 10/76 T |
| 3,069,917 | 12/1962 | Hilgers | 10/12 T |
| 3,583,012 | 6/1971 | Van de Meerendonk | 10/76 T |

*Primary Examiner*—Michael J. Keenan

*Attorney, Agent, or Firm*—McNenny, Pearne, Gordon, Gail, Dickinson & Schiller

[57] ABSTRACT

A transfer for a forging or forming machine is disclosed in which the transfer assembly is journaled for pivotal rotation about an axis midway between adjacent die stations. The transfer fingers are mounted to extend radially from the pivot axis to gripper portions at the distal end. The structure provides a minimum rotational moment of inertia and dynamic imbalance to permit the transfer to operate at higher speeds. An embodiment is disclosed in which a parallelogram type mechanism connects between adjacent transfer assemblies to permit transfer without turning of the workpiece to one station and transfer with turning of the workpiece at another die station. The transfer drive is arranged on the side of the machine remote from the operator's position to provide better operator access to the machine. A simple connection is provided between the transfer and its drive which is automatically disconnected when the transfer is raised and which is reconnected when the transfer is again lowered to the operative position.

19 Claims, 9 Drawing Figures

Fig. 2
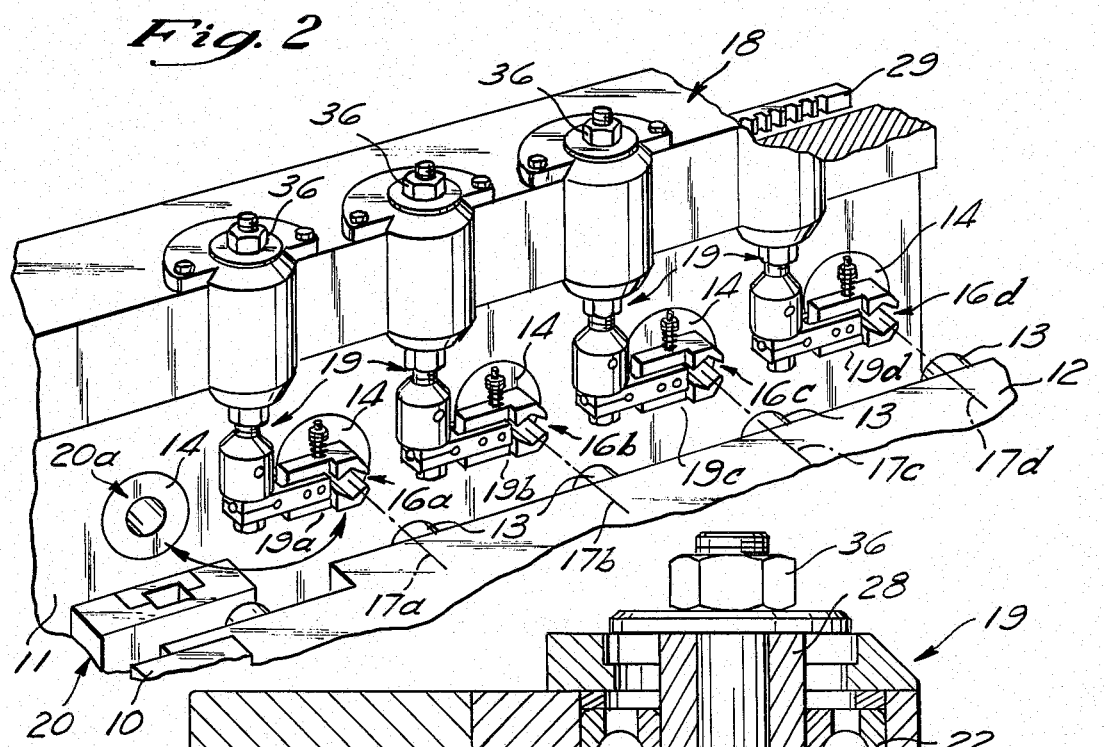
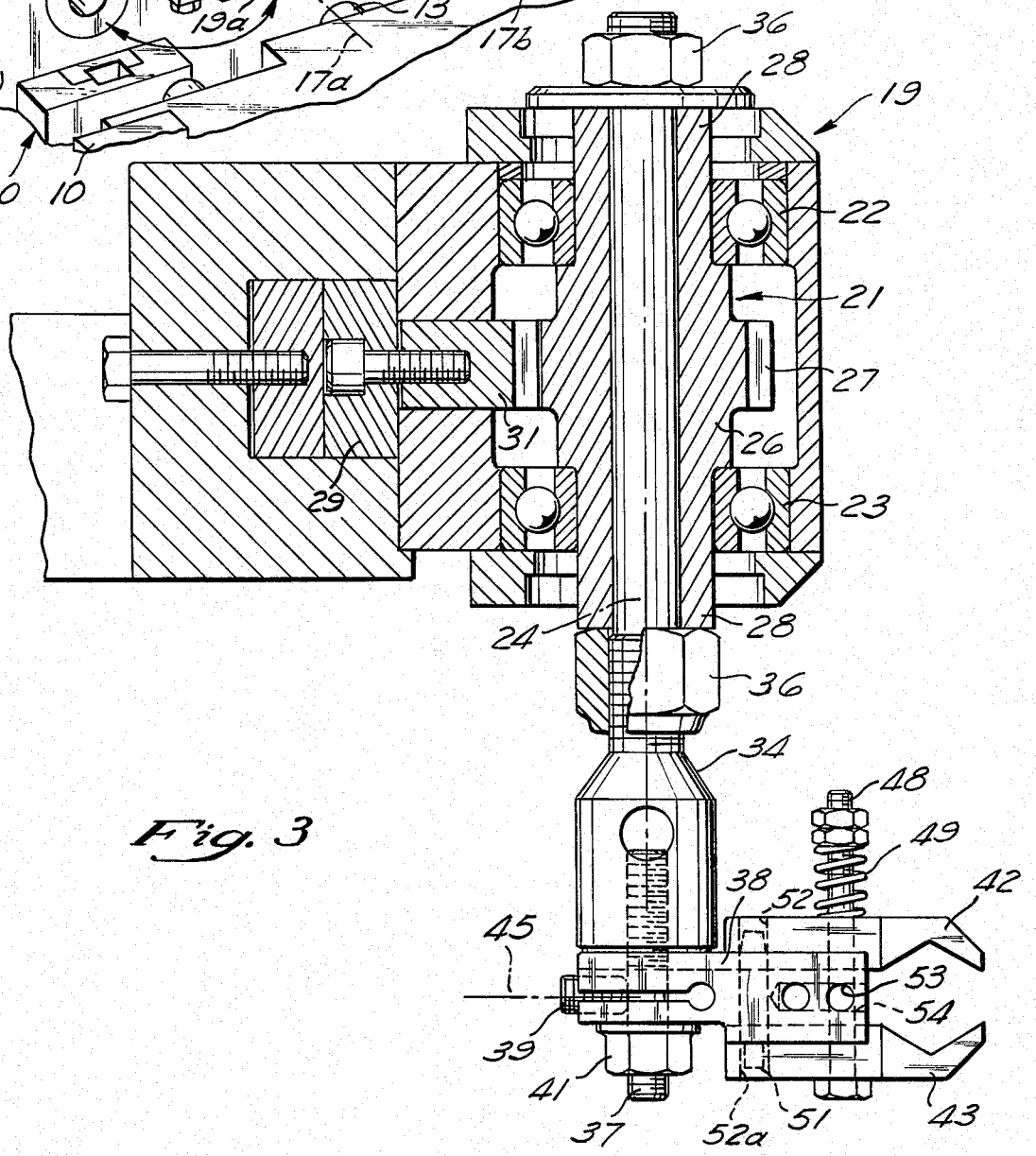
Fig. 3

Fig. 4
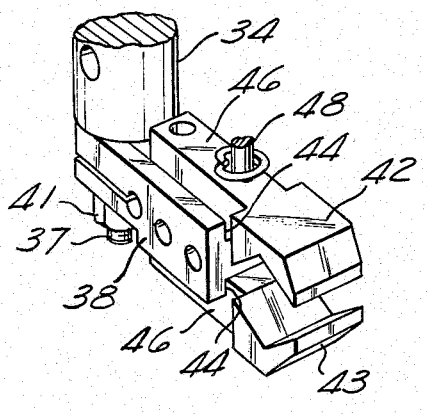
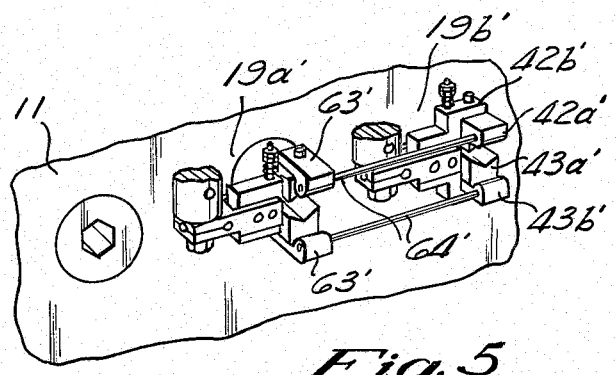
Fig. 5
Fig. 6
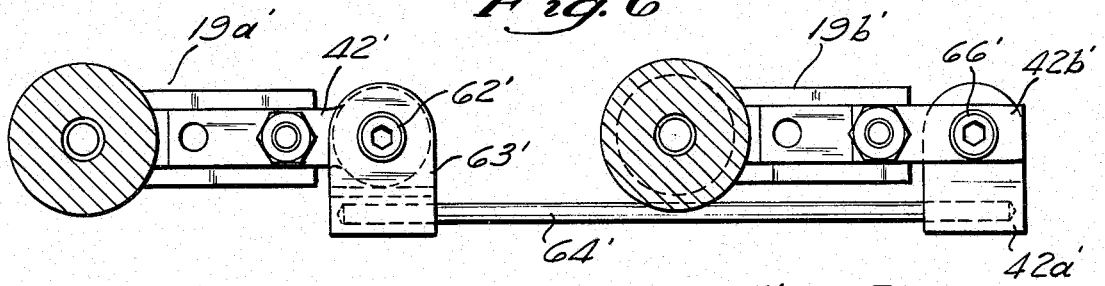
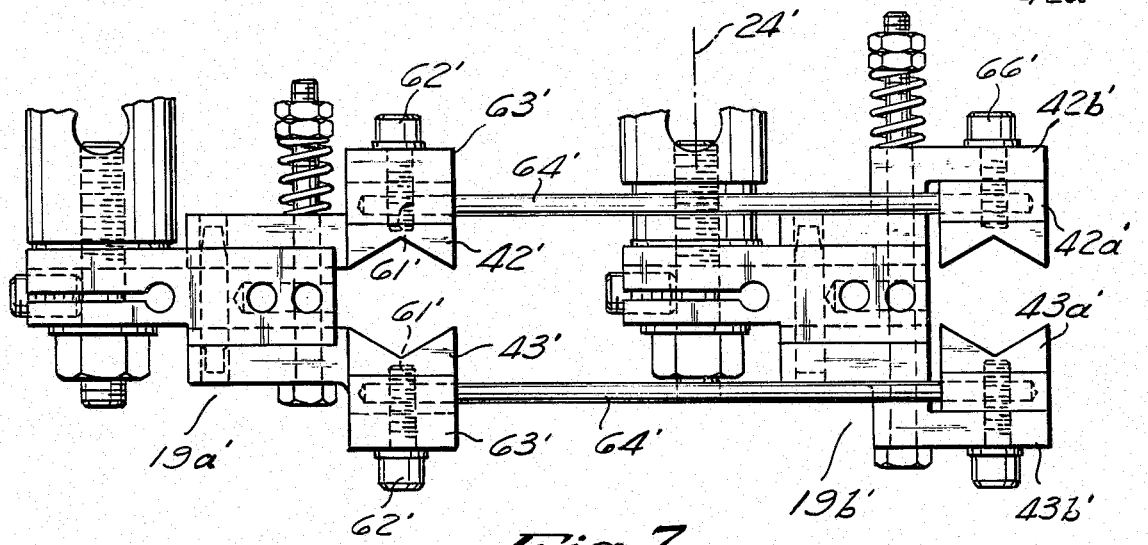
Fig. 7

HIGH SPEED TRANSFER

BACKGROUND OF THE INVENTION

This invention relates generally to forging or forming machines in which workpieces are progressively worked at a plurality of die stations, and more particularly to such machines provided with an improved transfer means constructed for high speed operation.

PRIOR ART

Transfer forging or forming machines which progressively shape a workpiece to a desired shape are well known. In such machines a transfer is provided to receive a workpiece at one location, such as a die station, and to deliver such workpiece to a subsequent die station for subsequent working operations. Examples of such transfers are described in the U.S. Letters Pat. No. 2,100,028 dated Nov. 23, 1937 and No. 2,689,358 dated Sept. 21, 1974. The latter of these patents is assigned to the assignee of the present invention and incorporated herein by reference.

Each of these patents describe a transfer having grippers supported for oscillating rotation about a pivot axis substantially midway between adjacent die stations. Transfer is accomplished by rotating the gripper support around such axis through 180°. The transfer of the latter of these patents can be operated so that the workpiece is rotated through 180° during transfer or is transferred without rotation.

Such transfers function well but their structure provides large eccentric masses. Consequently, difficulty is encountered if they are operated at very high speeds. The large eccentric mass provides a large moment of rotational inertia which must be overcome when the transfer is accelerated and decelerated thereby imposing high loads on the drive mechanism. Also such large eccentric masses produce high dynamic imbalance. Consequently, such transfers are inherently limited in operating speed.

SUMMARY OF THE INVENTION

In accordance with the present invention a novel and improved transfer and drive is provided which can operate at higher speeds. In the illustrated embodiments the transfer provides a support shaft pivoted for oscillating rotation about a pivot axis located substantially midway between the associated die stations. The shaft extends to a lower end which intersects the transfer plane containing the working axes of the die stations and described by the locus of the workpiece as it moves between the die stations. Mounted on the support shaft substantially along the transfer plane is a radially extending gripper mechanism which extends from the pivot axis and is provided with a gripper portion positioned to receive a workpiece in the gripping position and to carry the workpiece through an arc of 180° to a delivery position adjacent to the subsequent die station.

The structure of the gripper mechanism and of the transfer in general is arranged so that a minimum eccentrio mass is provided. Consequently, high dynamic imbalance is not encountered and the transfer can be operated at higher speeds than the transfers of prior art such as the patents cited above. Further, the structure is arranged to minimize the rotational moment of inertia of the transfer so that the forces on the drive system imposed during acceleration and deceleration of the transfer are not as high. Therefore, a lighter drive mechanism can be provided which inherently has reduced balancing problems.

In the illustrated embodiment the support shaft is journaled on spaced bearings and is provided with a pinion gear intermediate the bearings. The pinion gear meshes with a reciprocating rack slidably guided on the frame of the machine.

The rack is driven by a double cam drive provided by complimentary cams powered from the main crankshaft of the machine. The drive is located on the side of the machine remote from the operator's location to provide better operator access to the machine. The drive is arranged to provide zero backlash between the drive and the rack. A connection is provided between the drive and the rack which is automatically released when the transfer is raised from its normal operative position and which is easily reconnected when the transfer is again lowered into its operative position.

In one embodiment of this invention the gripper mechanism is constructed so that a workpiece carried by the gripper is turned through 180° as it is transferred from one die station to the next. Such embodiment is known as a turn-over transfer. In another embodiment means are provided to maintain the same orientation of the workpiece as the workpiece is carried through the 180° arc from the pick up position to the delivery position. With this invention a given transfer mechanism can provide for a turn-over transfer between one pair of adjacent die stations and transfer without turning of the workpiece between another pair of adjacent die stations.

These and other aspects of the invention are described in greater detail in the following description and drawings.

BRIEF DESCRIPTION OF THE DRAWINGS

FIG. 2 is a fragmentary perspective view illustrating a forging machine for the manufacture of hexagonal nuts and including a transfer in accordance with one embodiment of this invention;

FIG. 3 is an enlarged fragmentary section taken along the center line of one of the transfer grippers illustrating the structure of the rack and pinion drive mechanism and illustrating the gripper in a mid position in its transfer movement;

FIG. 4 is a fragmentary perspective view of the gripper portion of the transfer illustrated in FIG. 3;

FIG. 5 is a fragmentary perspective view of a second embodiment of this invention in which one of the transfer grippers is constructed so that the workpiece is not turned as it is carried by the transfer from one die station to the next;

FIG. 6 is a plan view of the transfer illustrated in FIG. 5;

FIG. 7 is a side elevation of the transfer illustrated in FIGS. 5 and 6;

DETAILED DESCRIPTION OF THE DRAWINGS

Figure 1:
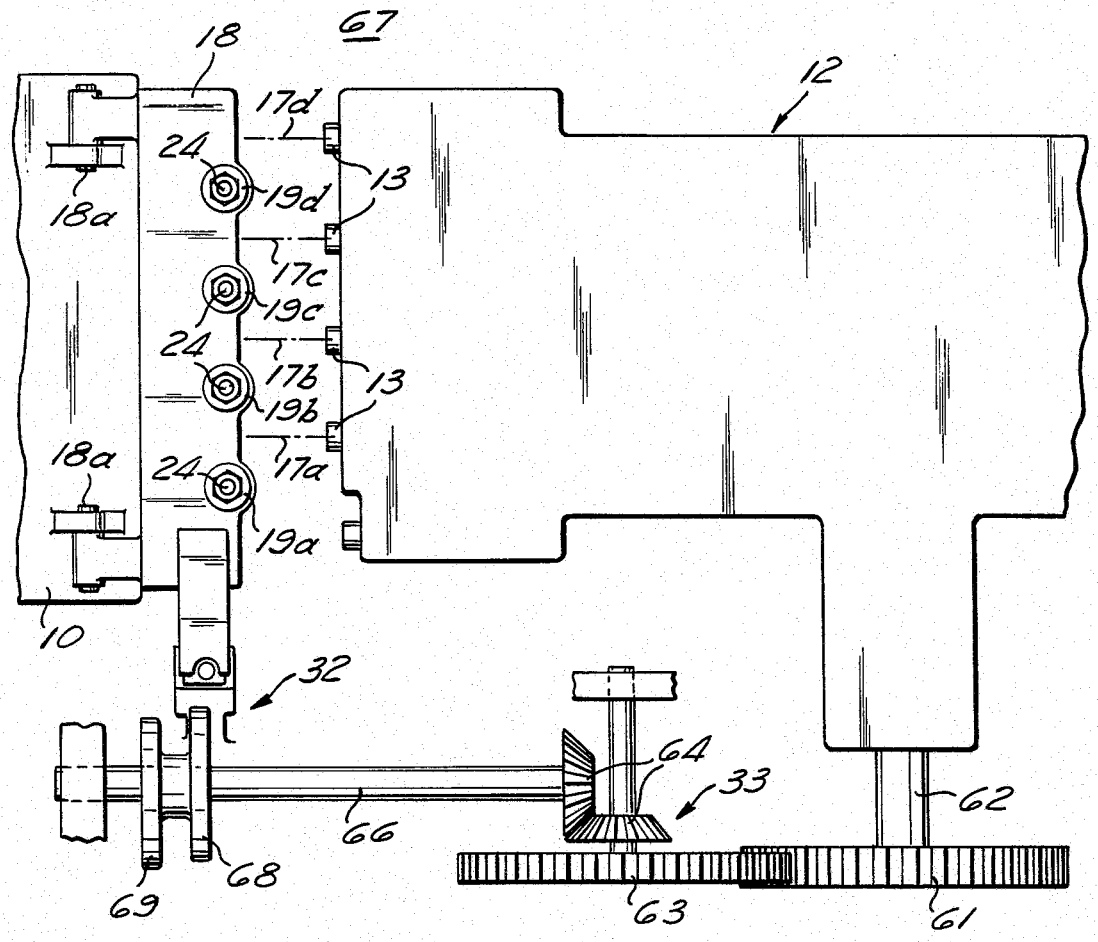
FIG. 1 is a schematic plan view of a progressive forming machine incorporating a transfer in accordance with the present invention.

Referring to FIGS. 1 through 4, a progressive former is schematically illustrated for forming nuts or the like. Such former includes a frame 10 with a die breast 11 mounted therein. A slide 12 is reciprocable in the frame toward and away from the die breast and supports tools 13 which cooperate with dies 14 to provide a plurality of work stations 16*a* through 16*d*. The tools and dies are located so that the die stations have working axes 17*a* through 17*d* which are equally spaced across the die breast 11. The machine also includes a shear mechanism 20 which operates to shear blanks from wire stock and to deliver such blanks to a transfer station 20*a*.

Supported on the frame 10 above the die breast 11 is a transfer mechanism 18 providing a plurality of transfer assemblies 19 of similar structure. Such mechanism operates to progressively transfer blanks from the transfer station 20*a* to each die station 19*a* through 19*d* so that the blank is progressively worked to the desired shape. The transfer 18 is mounted for pivotal movement about pivots 18*a* between its normal operating position and a raised position in which better access is provided to the dies.

Referring to FIG. 2 each assembly 19 includes a gripper support shaft assembly 21 supported on spaced bearings 22 and 23 for oscillating rotation about a pivot axis 24.

The shaft assembly 21 includes a tubular gear member 26 providing a centrally located pinion gear 27 and oppositely extending bearing extensions 28 which extend through the bearings 22 and 23 so that the tubular gear member 26 is journaled for rotation about the axis 24. The pinion gear 27 meshes with a gear rack 31 which is bolted to a bearing member 29 to guide the rack for reciprocating movement laterally with respect to the machine.

Referring to FIG. 1 the end of the rack 29 is connected to a cam drive system 32 which functions to produce the driving reciprocation of the rack. The cam drive system (described in detail below) is powered by a one-to-one gear system 33 so that it operates in timed relation to the reciprocation of the slide 12.

Referring again to FIG. 3 the shaft assembly 21 also includes a shaft member 34 threaded to receive a lock nut 36 and extending up through the tubular gear 26 to an upper end which is also threaded for a lock nut 36. The two lock nuts 36 cooperate when tightened to clamp the shaft member 34 for rotation with the tubular gear member and provide vertical adjustment of the gripper.

The lower end of the shaft member 34 is threaded to receive a stud bolt 37 which in turn serves to connect a gripper support arm 38 to the lower end of the shaft member 34. A set screw 39 and a lock nut 41 operate to adjustably mount the gripper support arm 38 on the lower end of the shaft member 34.

The gripper arm 38 extends laterally from the axis 24 and provides the support for a pair of gripper fingers 42 and 43. As best illustrated in FIG. 4 the gripper arm 38 is formed with opposed channels 44 which receive extensions 46 on the fingers 42 and 43 respectively. A bolt type fastener 48 extends through the fingers 42 and 43 and also through the gripper arm 38. A spring 49 on the bolt 48 resiliently urges the fingers 42 and 43 toward each other and allows them to open for gripping a workpiece. A pin 51 provided with a tapered upper end extends through the gripper arm 38 and into mating openings 52 in the finger 42 to prevent movement of the finger in the direction of the arm. The lower end of the pin 51 loosely fits into an opening 52*a* in the extension of the finger 43. This mounting arrangement securely mounts the finger 42 on the transfer arm 38 and resiliently biases the ends of the fingers 42 and 43 toward the gripping position while allowing the fingers to spread when a blank is positioned between the fingers for transfer from one location to another. The loose coupling between the lower end of the pin 51 and the finger 43 allows the finger 43 to float and align itself with the finger 42. The ends of the fingers 42 and 43 are formed with opposed gripping surfaces which operate to grip the blank being transferred. In the illustrated embodiment the figures are shaped to grip a hexagonal nut blank.

In the operation of the transfer illustrated in FIGS. 1 through 3 the first transfer assembly moves with oscillating rotation between a pick up position in which a blank is gripped at the transfer station 20*a* and a delivery position in which a blank is positioned in front of the die at the first die station 16*a*. An ejector (not illustrated) functions to eject the blank from the transfer station into the gripper fingers of the first transfer assembly. Similarly as the slide 12 approaches the die breast while the transfer is in the delivery position the associated tool carried by the slide pushes the blank out of the transfer fingers into the die at the first die station 16*a*. After the working operation has been completed and the slide 12 moves back from the die breast the transfer is operated to move the first transfer assembly back to receive a subsequent blank at the transfer station 20*a*.

Simultaneously, the second transfer assembly moves to a pick up position adjacent to the first die station 16*a* where a blank is ejected into its gripper fingers for subsequent transfer to the second die station 16*b*. The remaining two transfer assemblies 19 function to progressively transfer a blank from the second die station 16*b* to the third die station 16*c* and from the third die station 16*c* to the fourth die station 16*b*. In this embodiment the blank is turned through 180° during each transfer operation and the transfer therefor is of the type referred to as a turnover transfer.

The structure just described minimizes the eccentric mass of the transfer since the transfer fingers 42 and 43 are supported by a gripper arm which extends radially from the axis 24 along the plane of transfer 45 defined by the locus of the movement of the blank as it is transferred from one position to another. Such plane also contains the working axes 17*a* through 17*d*. Also the eccentricity of the mass is minimized since only the ends of the gripper fingers themselves are spaced from the axis 24 by the full radius.

The gripper arm is formed with lateral passages 53 and a radial passage 54 to make them more crushable in the event of a jamming or other malfunction and to lighten the gripper arm and reduce to the maximum extent the eccentric mass of the system. Because the eccentric mass of the system is reduced the forces on the drive to create the required acceleration and deceleration are reduced. Further, the reduction in the eccentric mass of the system also reduces any dynamic imbalance for a given speed. Consequently the system is capable of higher speed operation without excessive wear or maintenance problems.

FIGS. 5 through 7 illustrated in embodiment of this invention are arranged so that transfer can be accomplished without turning the blank through 180°. In this embodiment similar reference numerals are used to refer to the parts which are similar to the first embodiment, however, a prime (') is added to indicate that reference is being made to the second embodiment.

The structure of this embodiment which is illustrated is arranged so that turnover transfer is provided by the first transfer assembly 19a' and non-turnover transfer is provided by the second transfer assembly 19b'. The structure of the transfer assembly 19a' is substantially identical to the structure of the transfer assemblies 19 of the first embodiment with exception that the fingers 42' and 43' are each provided with a tapped bore 61' to receive a bolt type fastener 62'. The fasteners 62' serve as pivot mountings for lateral members 63' each of which is connected to one end of a connecting rod 64'. The opposite end of each connecting rod 64' is anchored in a gripper finger 42a' and 43a' which are in turn pivotally connected to a finger support member 42b' and 43b' by a pivot bolt 66'. With this structure the fingers 42a' and 43a' are supported for accurate movement about the associated axis 24' but are restrained by the rods 64' from turning with the support arm 42b' and 43b'.

In essence the support assemblies and tie rod 64' constitute a parallelogram mechanism so that the fingers 42a' and 43a' are held against turning even though they move along an accurate path of transfer. The fingers 42' and 43' in the embodiment of FIGS. 4 through 6, however, do turn during transfer movement in the illustrated embodiment.

In the event that two adjacent transfers are required to operate without either transfer assembly turning the blank, a structure similar to the structure of the assembly 19b' is provided at the adjacent transfer assembly and the tie rods prevent rotation of both transfer assemblies.

It is clear that with this arrangement any given transfer assembly can be arranged to provide turnover transfer or non-turnover transfer as required. It is recognized that the eccentric mass of the system of the second embodiment is higher than the eccentric mass of the system of the first embodiment. However, even in such embodiment the eccentric mass is less than in the corresponding prior art known to the applicant. Here, again, the reduction of the eccentric mass allows greater operating speeds without encountering excessive dynamic imbalance and excessive driving loads on the drive system.

Figure 9:
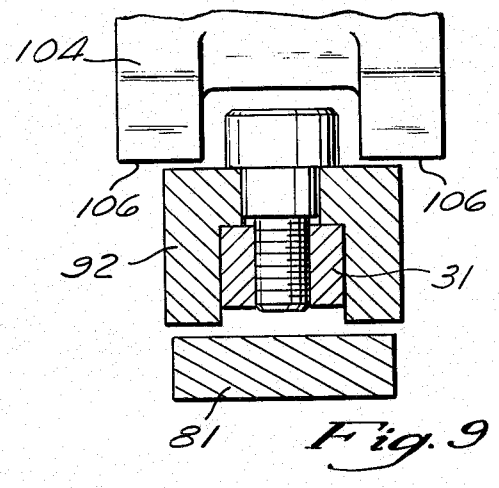
Figure 8:
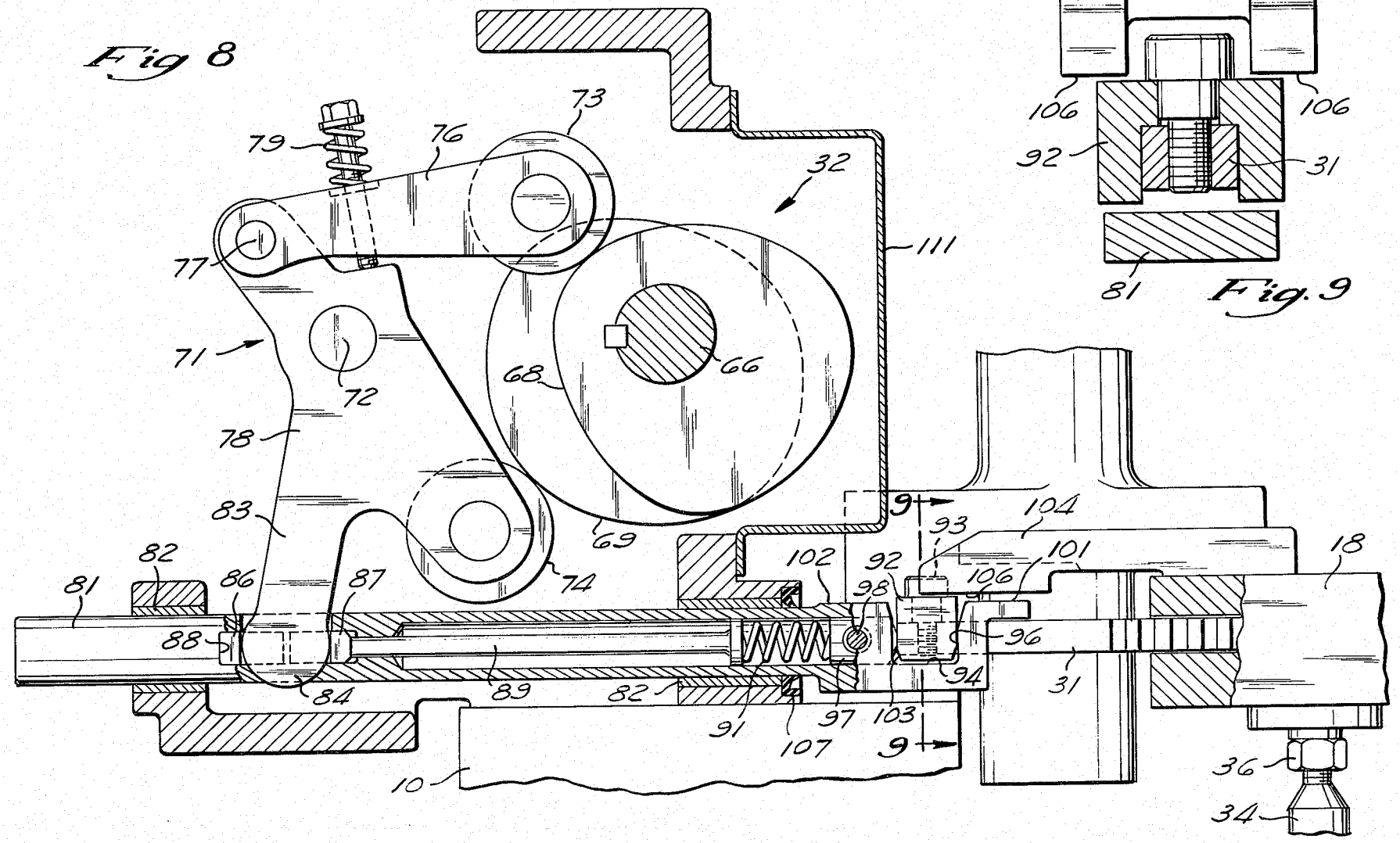
FIG. 8 is a side elevation of the transfer drive illustrating the cam drive structure and the connection between the transfer rack and the cam drive which is automatically disconnected when the transfer is raised from its operative position; and, FIG. 9 is an enlarged fragmentary cross section of the connection between the rack and the cam drive.

The transfer drive system is illustrated in FIGS. 1, 8 and 9. The gear drive 33 includes a drive gear 61 mounted on the crankshaft 62 of the machine and a mating driven gear 63. A pair of miter gears 64 are in turn driven by the gear 63 and power a cam shaft 66 journaled on the machine frame. The drive system is located on the side of the machine remote from the operator's position indicated generally at 67.

Referring to FIGS. 8 and 9 the cam drive system 32 includes a pair of complimentary cam 68 and 69 mounted on the cam shaft 66. A follower assembly 71 is pivoted on the machine frame for oscillating rotation about a pivot axis 72 and includes a first cam follower 73 engageable with the cam 68 and a second cam follower 74 engageable with the cam 69. The cam follower 73 is journaled on a support arm 76 pivotally mounted at 77 on the main follower arm 78. A spring 79 biases the arm 76 in a direction tending to maintain the cam follower 73 in engagement with its associated cam 68. Such structure operates to insure that the cam follower 74 remains in engagement with its associated cam 69. Since the two cams are complimentary however, little or no movement of the follower arm 76 around its pivot 77 occurs. With this structure the main follower arm 78 is driven in both directions for oscillating rotation by the two cams.

A reciprocating slide 81 is supported in bearings 82 on the machine frame 10 for linear reciprocation. A projection 83 on the follower arm 78 extends into an opening in the slide 81 and is provided with a cylindrical end portion 84 positioned between a pair of hardened bearing elements 86 and 87 carried by the slide. The bearing element 86 is bottomed against a surface 88 but the bearing element 87 is free for limited movement with respect to the slide. In order to insure that no backlash is present a push rod 89 is provided in the slide 81 and is biased by a spring 91 in a direction maintaining the bearing member 87 in engagement with a cylindrical portion 84. The two springs 79 and 91 function to insure that no backlash is present in the system.

Mounted on the end of the rack 31 is a lug 92 having a generally U-shape best illustrated in FIG. 9. In the illustrated embodiment the lug 92 is secured to the rack 31 by a cap screw 93. The lug 92 is positioned in a recess 94 in the end of the slide 81 and is engaged on one side by a lateral wall 96 of such recess and on the other side by a plug 97. The plug 97 is mounted by a cross pin 98 in the end of the slide 81 for limited movement and is biased in a direction toward the lug 92 by the spring 91. With this structural arrangement the spring 91 also functions to prevent backlash at the connecting lug so that when the lug is positioned as illustrated in FIG. 8 the rack 31 is driven with the slide 81, without backlash, for its reciprocating movement required by the transfer.

When the transfer 18 is raised to allow better access to the dies the lug 92 is raised up out of the recess 94 and the connection between the transfer and the cam drive is automatically disconnected. Consequently the operator can raise the transfer from the operator's position 67 without reaching over the machine and without going around the machine to disconnect the transfer drive.

When the transfer is again lowered to its operative position the lug moves back down toward the position illustrated. If the machine has been jogged or if the transfer has been moved to cause the lug to be in a position out of alignment with the recess 94 the lower end of the lug engages either the surface 101 or 102 on the slide. The operator then merely turns the transfer to move the lug into proper position so that it drops down into the recess 94 to complete the reconnection of the transfer and its drive. During such movement the chamfered end 103 on the lug cams the plug 97 back against the action of the spring.

In order to protect the rack 31 if the transfer is dropped or allowed to impact either of the surfaces 101 or 102 a bracing member 104 is provided on the transfer frame. This member provides a pair of surfaces 106 on each side of the capscrew 93 which are engaged by the lug, to prevent bending of the rack, before sufficient deflection occurs to damage the rack. Normally, a slight running clearance is provided between the surfaces 106 and the top surface of the lug 92.

A dynamic seal 107 is preferably mounted adjacent to the bearing 82 to prevent leakage of lubricant along the slide 81 into the working zone of the machine and to prevent contamination of the lubricant provided for the cam drive system 32. The cam and the cam followers are enclosed at 111 from the main working zone of the machine and are lubricated in the usual manner. Lubrication, however, is not required for the connection provided by the lug 92 since there is no relative movement of any significance between the lug and the slide during the normal operation of the machine.

With the illustrated structure a positive mechanical drive is provided for the transfer during the operation of the transfer as it carried the workpiece from one die station to the next. The drive for returning the transfer to its initial pick up position is through the springs 79 and 91. However, these springs are sized so that they prevent backlash on such return movement so a positive drive is provided in both directions.

Although preferred embodiments of this invention are illustrated it is to be understood that various modifications and rearrangements may be resorted to without departing from the scope of the invention disclosed and claimed.

We claim:

1. A transfer forging machine or the like comprising a frame, a slide reciprocable on said frame, tools and dies on said frame and slide cooperating to provide a plurality of die stations having working axes spaced from each other along a transfer plane extending in the direction of slide reciprocating movement, a transfer operable in timed relation to the movement of said slide for progressively transferring a workpiece from one die station to the subsequent die station; said transfer including a shaft pivoted for rotation about an axis midway between adjacent die stations and substantially perpendicular to said transfer plane, said shaft extending substantially to said transfer plane, a drive means for rotatably oscillating said shaft through substantially 180° between a pick-up position and a delivery position, and a gripper assembly supported on such shaft substantially at said transfer plane and extending substantially perpendicular to said shaft along said transfer plane, said gripper assembly including a support portion and gripper portion at the distal end thereof to grip a workpiece at one station when said shaft is in said pick-up position and to transport and deliver such workpiece to a subsequent die station when such shaft moves to said delivery position, said gripper and support portions each extending substantially exclusively in a direction away from the axis of said shaft, whereby said gripper and support portions are adapted to provide the sole offset from said shaft to either of said pick-up or delivery positions whereby said transfer is constructed to provide a relatively small eccentric mass to reduce eccentric loads and inertia forces developed during the operation of said transfer.

2. A transfer forging machine as set forth in claim 1 wherein said support portion is provided by a support member mounted on said shaft and extending radially therefrom along said transfer plane, said support member being formed with opposed channels, and said gripper portions being provided by separate gripper fingers each mounted in one of said channels, and spring means connected between said gripper fingers resiliently biasing them toward each other and allowing them to open to receive a workpiece.

3. A transfer forging machine as set forth in claim 2 wherein a pin is mounted on said support member and extends into a bore formed in each gripper finger, said pin in cooperation with said channels operating to lock said gripper fingers against substantial movement with respect to said support member excepting movement toward and away from each other.

4. A transfer forging machine as set forth in claim 3 wherein said drive means includes a gear rack reciprocably mounted on said frame, and said shaft includes a pinion gear meshing with said gear rack.

5. A transfer forging machine as set forth in claim 1 wherein said transfer includes a plurality of shafts pivoted for rotation about an axis midway between adjacent die stations each provided with a gripper assembly, the gripper portions of at least one gripper assembly being pivotally mounted for rotation about a first pivot axis parallel to the axis of said shaft, and control means connect between said gripper portions of said one assembly and another gripper assembly to prevent turning of said gripper portions of said one assembly as said shafts rotate from said pick up position to said delivery position.

6. A transfer forging machine as set forth in claim 5 wherein said control means are pivotably connected to said other assembly for pivotal movement about a second pivot axis, and said first and second pivot axes cooperate with the axes of said shafts to define a parallelogram.

7. A transfer forging machine as set forth in claim 6 wherein said control means includes an elongated member connected between each gripper finger of said one assembly and said other assembly.

8. A transfer forging machine as set forth in claim 5 wherein a workpiece is transferred by said one assembly without turning and is turned during the transfer by said other assembly.

9. A transfer forging machine as set forth in claim 5 wherein a workpiece is transferred without turning by both of said assemblies.

10. A transfer forging machine as set forth in claim 1 wherein said drive means includes a reciprocating rack connected to oscillate such shaft, and cam means are connected to mechanically drive said rack in both directions without backlash.

11. A transfer forging machine as set forth in claim 10 wherein said transfer is mounted for movement between an operative position and a raised position clear of said die stations, movement of said transfer to said raised position automatically disconnecting said rack from said cam means.

12. A transfer forging machine as set forth in claim 11 wherein said machine includes an operator position, and said cam means are located on the side of said machine remote from said operator position.

13. A transfer forging machine comprising a machine frame, a slide reciprocable on said machine frame, tools and dies on said slide and machine frame cooperating to define a plurality of die stations at which workpieces are progressively worked, and a transfer operable to progressively position workpieces at said die stations, said transfer including a transfer frame mounted on said machine frame for movement between an operative position and a raised position providing access to said die stations, a first drive member reciprocably mounted on said machine frame powered in timed relation to the operation of said slide, a second drive member reciprocably mounted on said transfer frame for movement in the same direction as said first member, and a releasable connection connecting said first member and said second member when said transfer frame is in said operative position and automatically disconnecting said first member from said second member when said transfer frame is moved to said raised position, said connection including biasing means on one of said first and second members to ensure that there is substantially no relative movement between said first and second members when they are interconnected by said connection.

14. A transfer forging machine as set forth in claim 13 wherein said connection includes a recess on one of said drive members and a projection on the other of said drive members which is positioned in said recess when said transfer frame is in said operative position, said connection being constructed so that there is substantially no relative movement between said recess and projection when said machine operates.

15. A transfer forging machine as set forth in claim 14 wherein said first drive member is mechanically driven in both directions by complimentary cam means, and said cam means and first member are located on the side of said machine remote from the position normally occupied by the operator of said machine, said transfer frame being movable to said raised position by an operator on the operator's side of said machine.

16. A transfer forging machine as set forth in claim 15 wherein said cam means includes spring means operable to prevent backlash.

17. A transfer forging machine as set forth in claim 16 wherein said spring means includes one spring operable to prevent backlash in said cam means and a second spring to prevent backlash in said connection.

18. A transfer forging machine or the like comprising a frame, a slide reciprocable on said frame, tools and dies on said frame and slide cooperating to provide a plurality of die stations having working axes spaced from each other along a transfer plane extending in the direction of slide reciprocating movement, a transfer operable in timed relation to the movement of said slide for progressively transferring a workpiece from one die station to the subsequent die station; said transfer including a shaft pivoted for rotation about an axis midway between adjacent die stations and substantially perpendicular to said transfer plane, a drive means for rotatably oscillating said shaft through substantially 180° between a pick-up position and a delivery position, and a gripper assembly supported on such shaft substantially along said transfer plane and extending substantially perpendicular to said shaft, said gripper assembly including a support portion and gripper portion at the distal end thereof to grip a workpiece at one station when said shaft is in said pick-up position and to transport and deliver such workpiece to a subsequent die station when such shaft moves to said delivery position, said transfer being constructed to provide a relatively small eccentric mass to reduce eccentric loads and inertia forces developed during the operation of said transfer, said support portion being provided by a support member mounted on said shaft and extending radially therefrom along said transfer plane, said support member being formed with opposed channels, said gripper portions being provided by separate gripper fingers each mounted in one of said channels, spring means connected between said gripper fingers resiliently biasing them toward each other and allowing them to open to receive a workpiece, a pin mounted on said support member and extending into a bore formed in each gripper finger, said pin in cooperation with said channels operating to lock said gripper fingers against substantial movement with respect to said support member excepting movement toward and away from each other, said pin being tapered at an end and fitting into a mating opening on one finger to allow pivotlike movement and being sized at its other end to loosely fit an opening in the other finger so that said other finger can float for alignment with said one finger.

19. A transfer forging machine or the like comprising a frame, a slide reciprocable on said frame, tools and dies on said frame and slide cooperating to provide a plurality of die stations having working axes spaced from each other along a transfer plane extending in the direction of slide reciprocating movement, a transfer operable in timed relation to the movement of said slide for progressively transferring a workpiece from one die station to the subsequent die station; said transfer including a shaft pivoted for rotation about an axis midway between adjacent die stations and substantially perpendicular to said transfer plane, a drive means for rotatably oscillating said shaft through substantially 180° between a pick-up position and a delivery position, and a gripper assembly supported on such shaft substantially along said transfer plane and extending substantially perpendicular to said shaft, said gripper assembly including a support portion and gripper portion at the distal end thereof to grip a workpiece at one station when said shaft is in said pick-up position and to transport and deliver such workpiece to a subsequent die station when such shaft moves to said delivery position, said transfer being constructed to provide a relatively small eccentric mass to reduce eccentric loads and inertia forces developed during the operation of said transfer, said drive means including a gear rack reciprocably mounted on said frame and a pinion gear journaled on said frame and meshing with said rack, said shaft being mounted on said pinion gear and being axially adjustable relative thereto.

* * * * *